US005743605A

United States Patent [19]

Marino

[11] Patent Number: 5,743,605

[45] Date of Patent: Apr. 28, 1998

[54] INFORMATION DISPLAY AND ARTICLE STORAGE AND DISPENSING APPARATUS

[76] Inventor: James F. Marino, 2620 St. Tropez Pl., La Jolla, Calif. 92037

[21] Appl. No.: 708,794

[22] Filed: Sep. 9, 1996

[51] Int. Cl.[6] ..... A47G 29/00

[52] U.S. Cl. ..... 312/211; 312/34.4; 312/327; 312/234.1; 221/58

[58] Field of Search ..... 40/306, 312, 649; 312/211, 34.1, 34.3, 34.4, 245, 242, 293.2, 327, 290, 283, 118, 312, 234, 234.1; 221/56, 58, 279, 36

[56] References Cited

U.S. PATENT DOCUMENTS

| | | | |
|---|---|---|---|
| 448,663 | 3/1891 | Moore | 312/34.1 |
| 557,095 | 3/1896 | Tate | 312/211 |
| 1,106,543 | 8/1914 | Burnham | 312/118 |
| 1,371,193 | 3/1921 | Benge | 312/327 X |
| 1,983,289 | 12/1934 | Hamner | 312/34.4 |
| 2,045,828 | 6/1936 | Borroughs | 312/34.4 |
| 2,376,916 | 5/1945 | Harden | 40/312 |
| 2,764,461 | 6/1956 | Montgomery | 312/327 X |
| 2,852,030 | 9/1958 | Nord | 312/283 X |
| 2,869,951 | 1/1959 | Wooster | 312/34.4 |
| 3,249,392 | 5/1966 | Berman | 312/118 |
| 3,310,353 | 3/1967 | Londis | 312/34.4 |
| 3,433,544 | 3/1969 | Monyette et al. | 312/34.4 |
| 4,491,242 | 1/1985 | Trinidad | 312/34.4 X |
| 5,251,972 | 10/1993 | Zurawin | 312/118 |

*Primary Examiner*—Peter M. Cuomo
*Assistant Examiner*—James O. Hansen
*Attorney, Agent, or Firm*—Flanagan & Flanagan; John R. Flanagan; John K. Flanagan

[57] ABSTRACT

A dual-purpose storage and display apparatus includes a storage and dispensing bin, a top cover for the bin, and an information display device mounted on the bin. The storage and dispensing bin defines an interior chamber for storing articles, which can be disposed in boxes and cartons in the bin, and a lower dispensing opening in the front of the bin through which the articles can be removed by users from the boxes and cartons stored in the interior chamber of the bin. The top cover is movable relative to the bin for opening and closing an open top of the bin. The information display device is mounted to the front of the bin above the lower dispensing opening for displaying information targeted to users who remove articles from the bin. The information display device can be a frame mounted to the front of the bin for defining a window and a slot at least partially surrounding the window for receiving the insertion therein of a sheet containing information for viewing through the window. A transparent pane can be mounted to the frame and extend across the window so as to cover the information sheet received behind the pane in the frame.

11 Claims, 5 Drawing Sheets

INFORMATION DISPLAY AND ARTICLE STORAGE AND DISPENSING APPARATUS

BACKGROUND OF THE INVENTION

1. Field of the Invention

The present invention generally relates to innovations whose objectives are the promotion of more efficient organization and utilization of space and time in the workplace and, more particularly, is concerned with apparatus which stores and dispenses articles in an organized manner and concurrently displays information.

2. Description of the Prior Art

Generally speaking, time and space are essential factors in the workplace but are both limited and costly in availability and thus are scarce resources. Nowhere is this more the case than in the medical profession, particularly with respect to the utilization of time and space by physicians in the workplace.

Physicians have to devote most of their time in attending to their patients. They also must reserve some time to review the constant flow of new information concerning medical innovations and the like. Much of this type of information is provided by advertisements in trade journals and salesmen that personally visit physicians' offices. Physicians tend to pass over and ignore trade journal print ads and salesmen encounter difficulty accessing physicians with sufficient free time to listen to their sales pitches. These demands placed on physicians' time makes it essential that every available moment of their time be used efficiently. Hospitals and medical offices also have demands placed on their available space making it essential that every corner and shelf area is used in an organized and efficient manner.

One particular workplace used by physicians where the physician/inventor of the present invention herein has perceived that improvements are needed in order to increase efficiency of time and space utilization and organization is the surgical scrub area. In the scrub area a sink is provided with one or more scrub stations in the front of which physicians must stand for five to ten minutes or so to scrub their hands and arms and to don head and shoe covers, and masks before entering the operating room. During this period the physicians' time, although not being truly wasted, is substantially underutilized in terms of the nature of tasks they are performing. It seems feasible that physicians could be doing other tasks concurrently with pre-op scrubbing and dressing preparation.

Also, in the scrub area a shelf is provided above the scrub sink for holding various disposable articles, such as towels, gloves, masks, brushes and the like, within easy reach of the physicians. Typically, these articles are contained in separate packages of varying sizes and shapes, such as cartons and boxes, which are placed horizontally side-by-side across the shelf in a substantially disordered and unprotected manner. This disorganization not only substantially underutilizes the total available shelf space but also makes these packages highly susceptible to being knocked off the shelf and falling into the wet sink where the entire package of articles become contaminated and have to be discarded.

SUMMARY OF THE INVENTION

The present invention provides an information display and article storage and dispensing apparatus designed to satisfy the aforementioned needs.

In contrast to the current practice of placing cartons and boxes containing different articles in a horizontal arrangement on a shelf above a work station, such as the shelf above the sink in the physicians' scrub area, the apparatus of the present invention incorporates a storage and dispensing bin which ensures that the boxes and cartons of articles are housed in an attractive, durable and stable manner preventing dislodging of the articles accidentally and thus decreasing losses due to contamination. At the same time, the storage and dispensing bin provides both horizontal and vertical storage capacity and bottom dispensing capability such that articles are positioned where they are readily accessible to physicians while standing in front of the scrub sink.

The apparatus of the present invention also incorporates an information display medium which takes up otherwise wasted or at least underutilized space on the storage and dispensing bin and employs otherwise wasted or at least underutilized periods of time of physicians as they are standing in front of the scrub sink. The information display medium is placed on the front wall or face of the storage and dispensing bin at or near eye level of physicians so as to make it easy and convenient for them to direct their attention to the messages presented. The information display on the storage bin can have a dual function: one being a bulletin board and the other being a billboard. The bulletin board feature of the information display medium can be used by various units of a hospital or a medical office to post announcements and information of interest to the physicians. The billboard feature can be rented and used by commercial concerns to provide product and service promotions.

Accordingly, the present invention is directed to a dual-purpose storage and display apparatus for storing boxes and cartons of articles, dispensing the articles such as individually, and displaying information. The storage and display apparatus comprises a storage and dispensing bin, a top cover and an information display device. The storage and dispensing bin has an interior chamber for storing therein articles such as disposed in boxes and cartons and a dispensing opening through which the articles can be removed by users from the boxes and cartons within the interior chamber of the bin. The information display device is mounted to the bin and is adapted to hold and display information, for example, that is particularly targeted to the users who remove articles from the bin.

More particularly, the storage and dispensing bin includes a rear wall, a pair of opposite side walls connected to the rear wall, a bottom wall connected to the rear wall and opposite side walls, and a front wall connected to the bottom wall and opposite side walls such that the rear wall, opposite side walls, bottom wall and front wall define the interior chamber of the bin and an open top of the bin. The front wall is shorter in height than the rear wall, and the opposite side walls have respective top edges which slope forwardly and downwardly from a top edge of the rear wall to a top edge of the front wall so as to define the open top of the bin at a rearwardly and upwardly inclined orientation.

The top cover for the bin is movable relative to the bin for opening and closing the inclined open top of the bin. Hinge means is provided which pivotally mounts the top cover to an upper portion of the rear wall of the bin for undergoing pivotal movement between opened and closed positions relative to the open top of the bin.

Also, the storage and display apparatus includes a leaf spring element removably mounted to the rear wall of the main enclosure of the bin via a notch formed in a top edge thereof. The leaf spring element extends downward and forward into the interior chamber of the bin for engaging and biasing articles therein toward the front wall and dispensing opening of the bin.

The information display device is mounted on the front wall of the bin. The front wall of the bin also has the dispensing opening formed therein with the information display device being disposed on the front wall above the dispensing opening. More particularly, the display device includes frame means mounted to the bin for defining a window and a slot at least partially surrounding the window for receiving the insertion of a sheet containing information for viewing through the window. The display device further includes a pane of transparent material mounted to the frame means and extending across the window so as to substantially cover the sheet received by the slot of the frame means.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
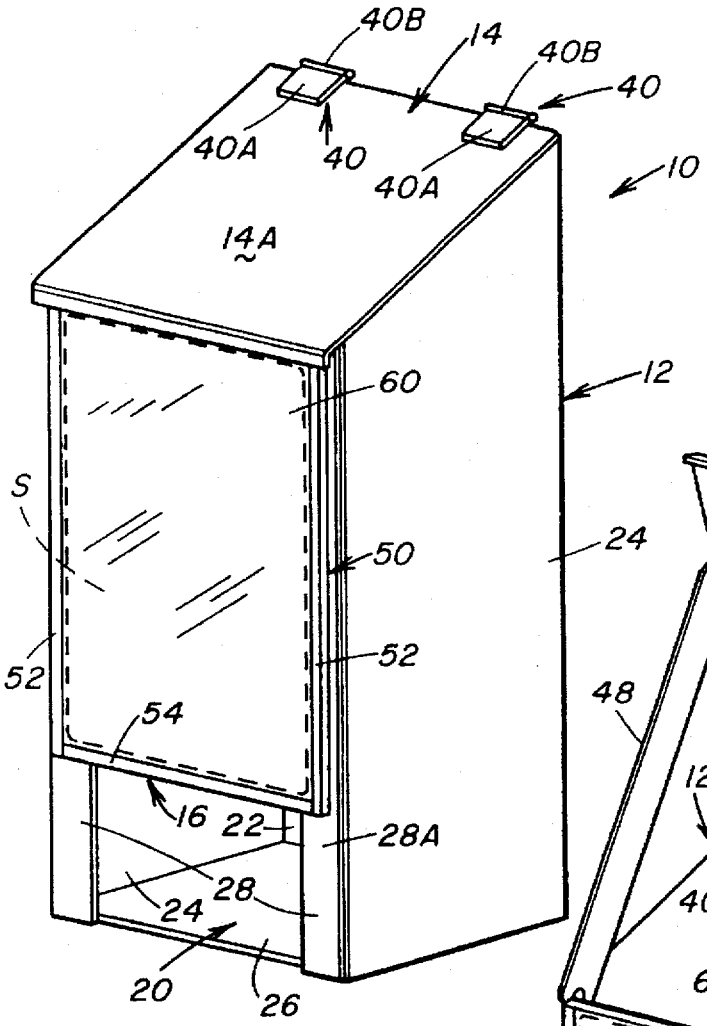
FIG. 1 is a front perspective view of the storage and display apparatus of the present invention having a cover in a closed position relative to a storage and dispensing bin of the apparatus.
Figure 2:
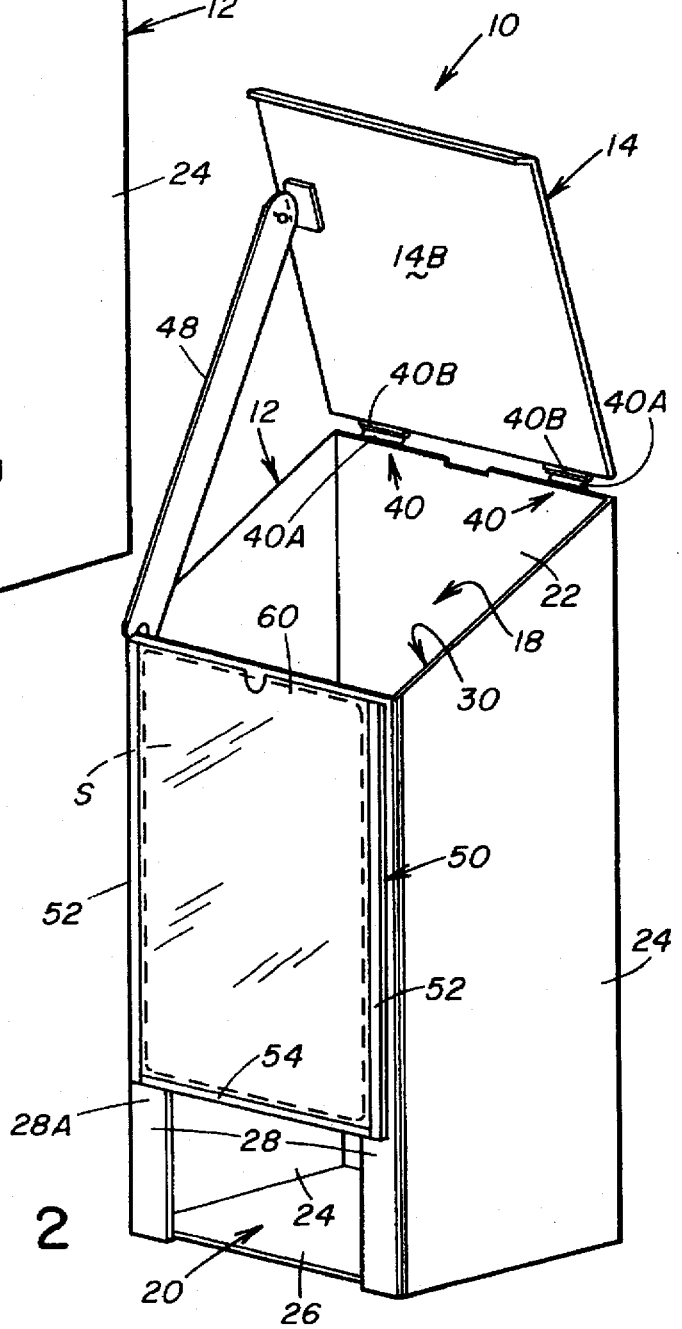
FIG. 2 another front perspective view similar to that of FIG. 1 but with the cover in a raised position relative to the bin.
Figure 5:
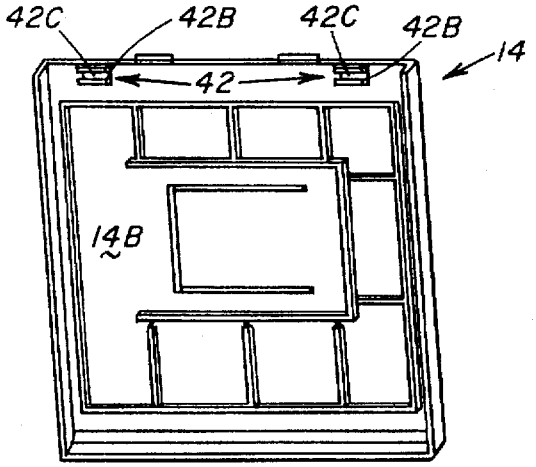
FIG. 5 is a rear perspective view of the cover.
Figure 4:
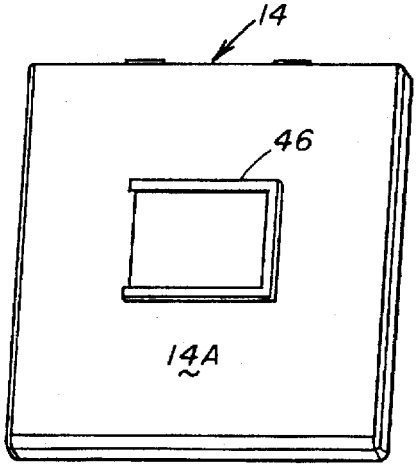
FIG. 4 is a front perspective view of the cover of the apparatus by itself.
Figure 3:
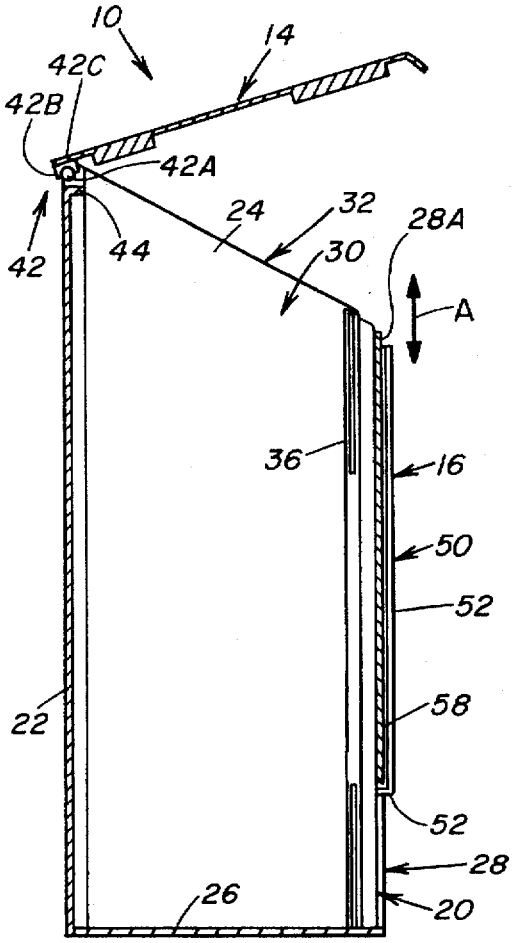
FIG. 3 is a vertical longitudinal sectional view of the apparatus with hinges connecting the cover to the bin having a construction slightly modified from that shown in FIGS. 1 and 2.

Referring to the drawings, and particularly to FIGS. 1 and 2, there is illustrated a dual-purpose storage and display apparatus, generally designated 10, of the present invention for storing and dispensing articles and for displaying information. The articles may be contained in packages, such as boxes and cartons, which are stored in the apparatus 10. In one particular application of the dual-purpose apparatus, the articles are disposable items, such as towels, gloves, head and shoe covers, masks, brushes and the like, commonly available in surgical scrub rooms.

The storage and display apparatus 10 basically includes a storage and dispensing bin 12, a top cover 14 for the bin 12, and an information display device 16 mounted to the front of the bin 12. The storage and dispensing bin 12 has an interior chamber 18 for storing articles therein and a dispensing opening 20 through which the articles can be removed, such as one at a time, from their packages by users. The information display device 16 is adapted to hold and display information, either physically or electronically, particularly targeted to and intended for the users that remove articles from the bin 12. By way of an example, a physical sheet S containing written information is shown in outline form in FIGS. 1 and 2.

Referring to FIGS. 1–3 and 6–20, the storage and dispensing bin 12 includes a rear wall 22, a pair of opposite side walls 24, a bottom wall 26, and a front wall 28. The opposite side walls 24 are connected at their rear vertical edges to the opposite side vertical edges of the rear wall 22. The bottom wall 26 is connected at its rear horizontal edge to the lower horizontal edge of the rear wall 22 and at its opposite side horizontal edges to the lower horizontal edges of the opposite side walls 24. The front wall 28 is connected to at its lower horizontal edges to the front horizontal edge of the bottom wall 26 and at its opposite side vertical edges to opposite front vertical edges of the opposite side walls 24. With such interconnected arrangement, the rear wall 22, side walls 24, bottom wall 26 and front wall 28 of the bin 12 together define the interior chamber 18 of the bin 12 for receiving and storing the packages of articles and also define an open top 30 of the bin 12 through which empty packages are removed from and new packages are placed into the chamber 18. In the illustrated example of the bin 12, the front wall 28 is shorter in height than the rear wall 22 while the opposite side walls 24 have respective top edges which slope forwardly and downwardly from a top edge of the rear wall 22 to a top edge of the front wall 28 so as to define the open top 30 of the bin 12 in a rearwardly and upwardly inclined orientation, as best seen in FIG. 2.

In one exemplary embodiment as shown in greater detail in FIGS. 3–20, the rear wall 22, side walls 24 and bottom wall 26 of the bin 12 are fixedly connected together to provide a main enclosure 32 having an open front 34, whereas the front wall 28 of the bin 12 is separate from the other walls and provides a front panel 28. The front panel 28 fits on the main enclosure 32 so as to extend across and closes the open front 34 of the main enclosure 32 such that together the main enclosure 32 and front panel 28 form the interior chamber 18 of the storage and dispensing bin 12. The front panel 28 has a lower cutout region which defines the lower front dispensing opening 20 for removing articles from their boxes and cartons stored within the interior chamber 18 of the bin 12. Also, a vertical divider, extending front to back, can be placed in the interior chamber 18 of the bin 12 for defining separate compartments therein for receiving and separating the boxes and cartons of articles stored therein.

More particularly, as seen in FIGS. 10–20 the front panel 28 has opposite vertical side edge portions 29 formed as rounded ninety-degree corners with first connection elements 36 in the form of ribs and channels defined therealong on the interior thereof which slidably interfit with second connections elements 38 in the form of complementary ribs and channels defined along the outside of vertical front edge portions of the opposite side walls 24 of the main enclosure 32. The first and second complementary connections elements 36, 38 permit the front panel 28 to be slidably lifted and raised (and then lowered as indicated by the double arrow A in FIG. 3) relative to the main enclosure 32 to temporarily enlarge the lower front opening 20 in order to remove empty packages from the interior chamber 18 and to replenish the interior chamber 18 with new full packages of articles and thereby avoid having to remove the bin 12 from an elevated shelf each time in order to refill it.

Referring to FIGS. 1–5, there is illustrated the top cover 14 which is movable for opening and closing the open top 30 of the storage and dispensing bin 12. The top cover 14 is pivotally connected to the rear wall 22 of the main enclosure 32 by either exterior hinges 40 as shown in FIGS. 1 and 2 or by interior hinges 42 as seen in FIGS. 3, 5–7 and 10–12. Each of the exterior hinges 40 includes a pair of flaps 40A pivotally connected to one another by a pivotal joint 40B and individually fixedly attached respectively to the top cover 14 and rear wall 22. Each of the interior hinges 42 includes a pivot bar 42A mounted across a recessed cavity 44 formed downwardly from the upper edge of the rear wall 22 and a block 42B defining an internal C-shaped socket 42C adapted to removably snap-fit over and rotate about the pivot bar 42A on the rear wall 22. Both hinges 40, 42 pivotally mount the top cover 14 to the upper portion of the rear wall 22 of the bin 12 for undergoing pivotal movement between the opened and closed positions relative to the open top 30 of the bin 12, as depicted respectively in FIGS. 1 and 2.

The top cover 14 also can have a pocket 46 attached on an exterior surface 14A of the top cover 14 for holding a sheet containing an itemized description of the contents of the bin 12. The apparatus 10 also may include a relatively stiff elongated arm 48 pivotally mounted at one end to the interior surface 14B of the top cover 14 and free at the opposite end. After the top cover 14 is pivoted to its opened position, the elongated arm 48 is extendable between the top cover 14 and top edge of the front panel 28 of the bin 12 for temporarily propping the top cover 14 upwardly at the opened position relative to the open top 30 of the bin 12. When not in use, the elongated arm 48 will extend downwardly into the interior chamber 18 of the bin 12 alongside the adjacent one of the opposite side walls 24 of the bin 12. Other suitable means such as coil springs provided around the hinge bars 42A can be employed to hold the top cover 14 at the opened position.

Figure 6:
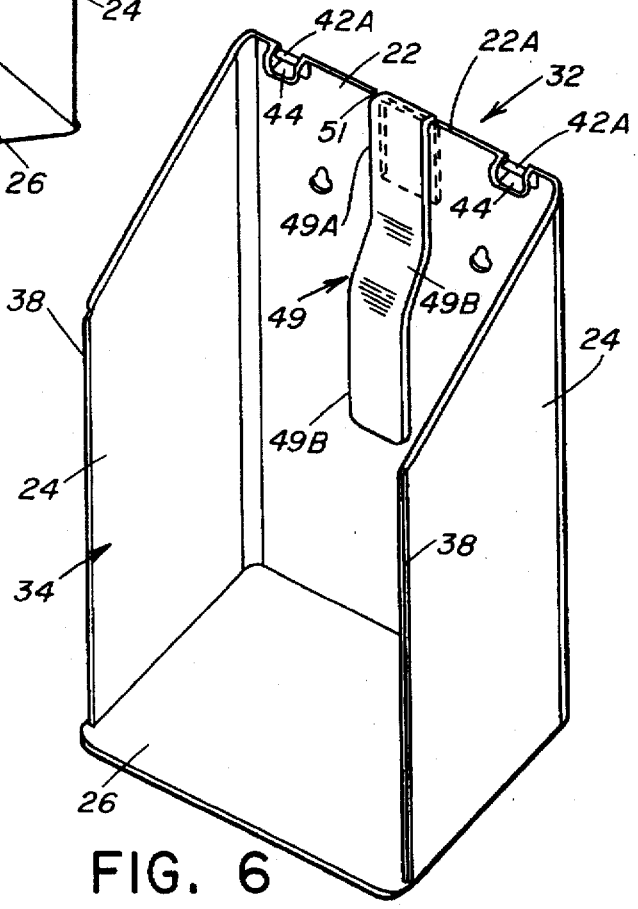
FIG. 6 is a front perspective view of a main enclosure of the storage and dispensing bin by itself.
Figure 13:
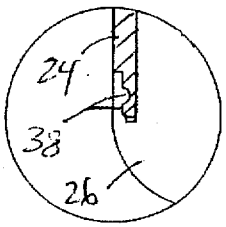
FIG. 13 is an enlarged detailed sectional view of the part of the main enclosure enclosed by circle 13 in FIG. 12.
Figure 11:
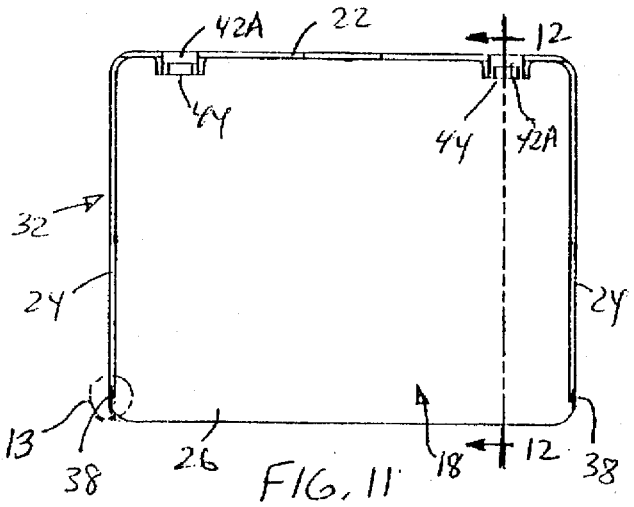
FIG. 11 is a top plan view of the main enclosure as seen along line 11—11 of FIG. 10.
Figure 12:
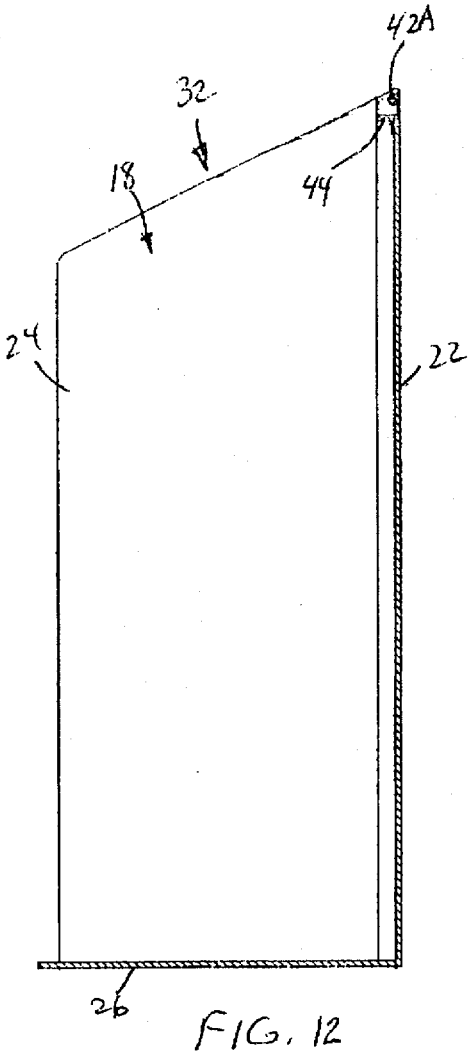
FIG. 12 is a vertical longitudinal sectional view of the main enclosure taken along line 12—12 of FIG. 11.
Figure 10:
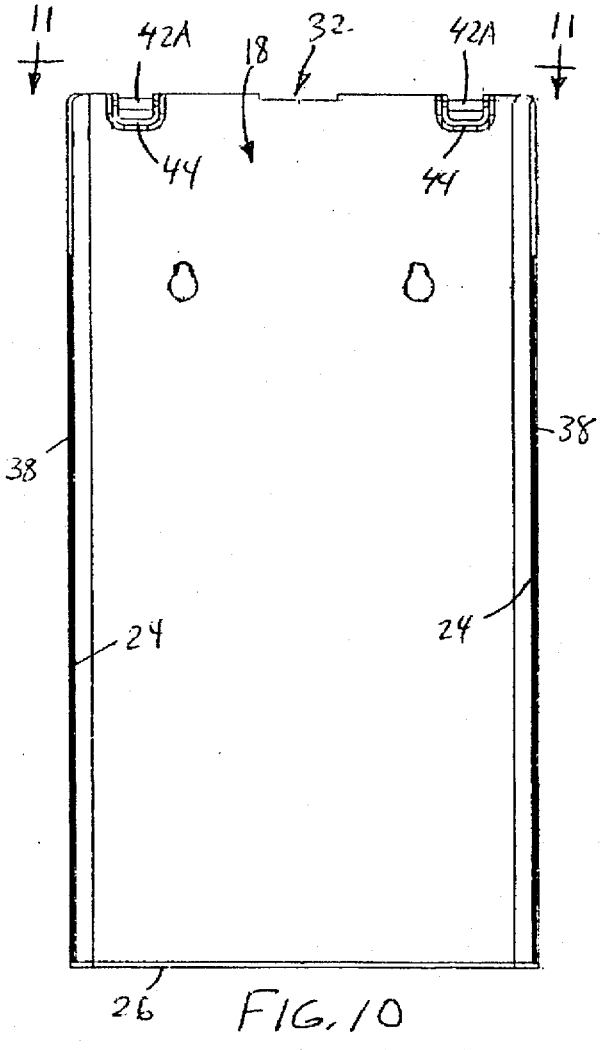
FIG. 10 is a front elevational view of the main enclosure.
Figure 14:
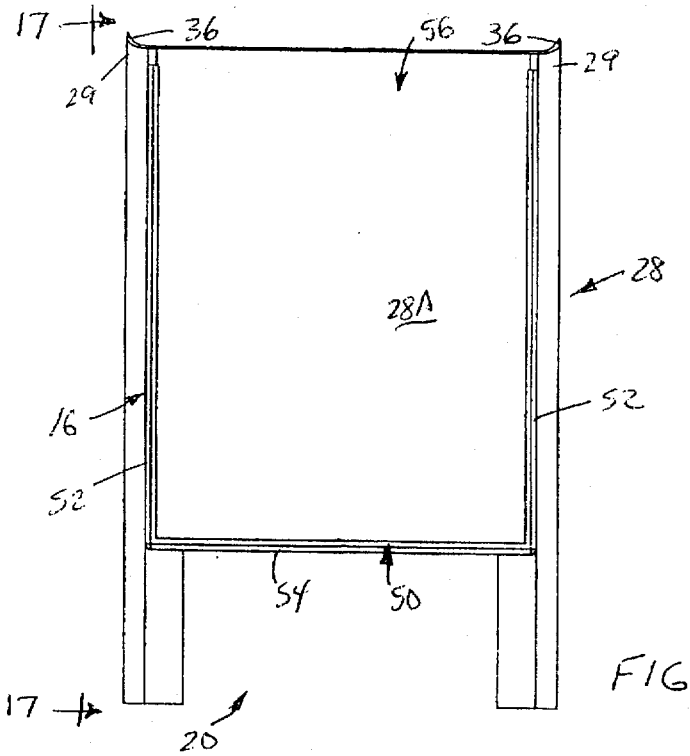
FIG. 14 is a front elevational view of the front panel.
Figure 20:
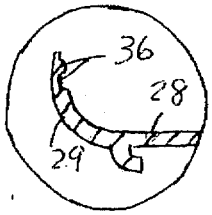
FIG. 20 is an enlarged detailed sectional view of the part of the front panel enclosed by circle 20 in FIG. 19.
Figure 18:
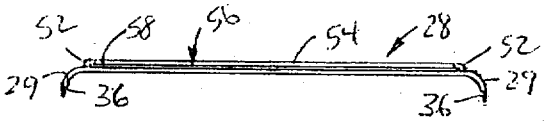
FIG. 18 is a top plan view of the front panel as seen along line 18—18 of FIG. 15.
Figure 19:
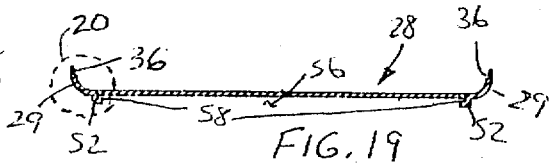
FIG. 19 is a cross-sectional view of the front panel taken along line 19—19 of FIG. 15.
Figure 15:
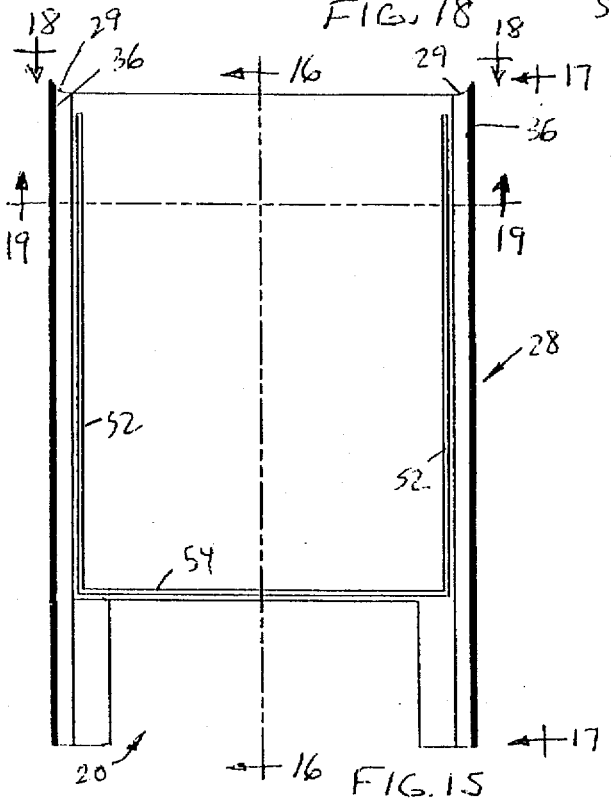
FIG. 15 is a rear elevational view of the front panel.
Figure 16:
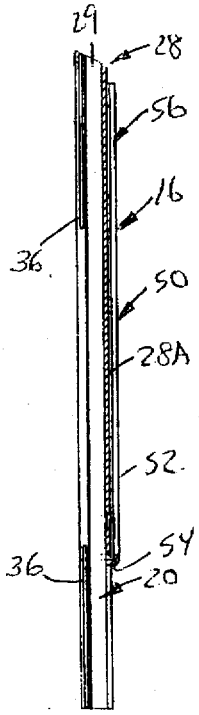
FIG. 16 is a vertical longitudinal sectional view of the front panel taken along line 16—16 of FIG. 15.
Figure 17:
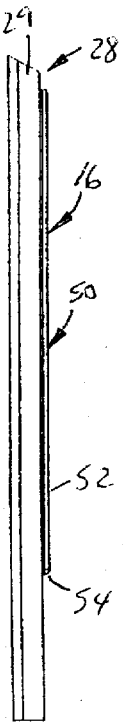
FIG. 17 is a side elevational view of the front panel as seen along line 17—17 of FIG. 15.

Referring to FIG. 6, the storage and display apparatus 10 also includes a leaf spring element 49 removably mounted over the rear wall 22 of the main enclosure 32 of the bin 12 via a notch 51 formed in a top edge 22A thereof. The leaf spring element 49 has an upper portion 49A being of U-shaped configuration for hanging over the top edge 22A of the rear wall 22 at the location of the notch 51 and a lower portion 49B being offset from the upper portion 49A by a middle portion 49C which extends downward and forward from the upper portion 49A so as to disposed the lower portion 49B in the interior chamber 18 of the bin 12 for engaging articles therein and biasing the articles toward the front wall 28 and dispensing opening 20 of the bin 12.

Referring now to FIGS. 3, 8, 9, and 14–19, there is illustrated the information display device 16 mounted to the front panel 28 of the bin 12 above the lower front dispensing opening 20 formed therein. The information display device 16 includes a generally U-shaped frame 50 formed by a pair of side members 52 and a bottom member 54 extending between and interconnecting the lower ends of the side members 52. The side members 52 and bottom member 54 are mounted to the exterior side 28A of the front panel 28 of the bin 12 so as to define a window 56 thereon. The side members 52 and bottom member 54 are generally L-shaped in cross-section so as to define a generally U-shaped slot 58 which at least partially surrounds the window 56 for receiving the insertion therein of the physical sheet S containing information thereon for viewing through the window 56. The display device 16 further includes a pane 60 of transparent material mounted to the frame 50 within the U-shaped slot 58 and extending across the window 56 so as to substantially cover and protect the sheet S also received behind the pane in the slot 58 of the frame 50.

Figure 21:
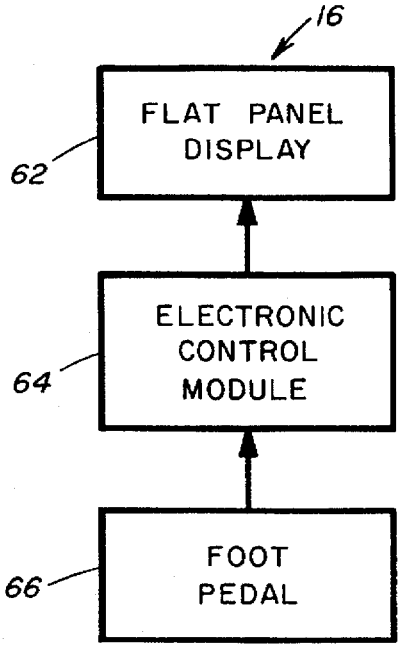
FIG. 21 is a diagrammatic view of an electronic information display device usable in conjunction with the front panel of the apparatus of the present invention.
Figure 7:
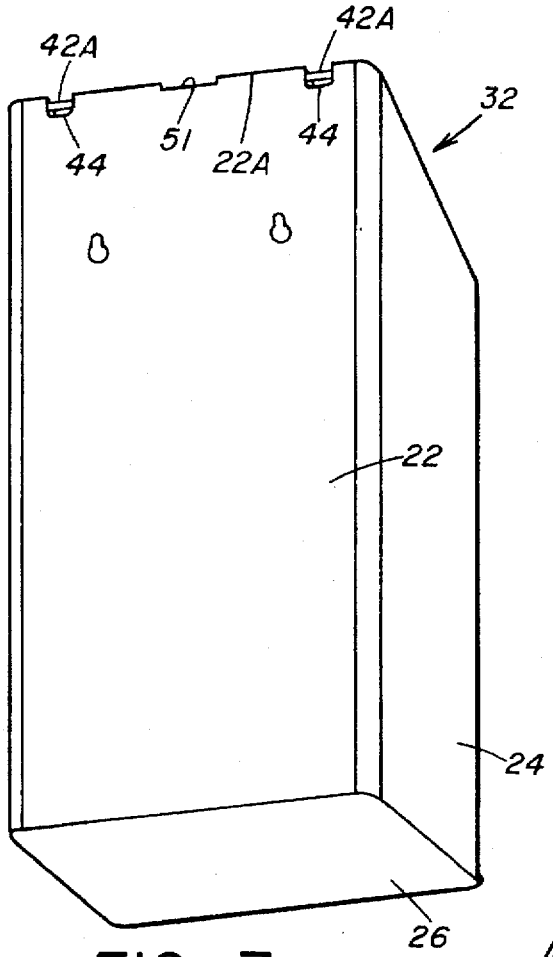
FIG. 7 is a rear perspective view of the main enclosure.
Figure 9:
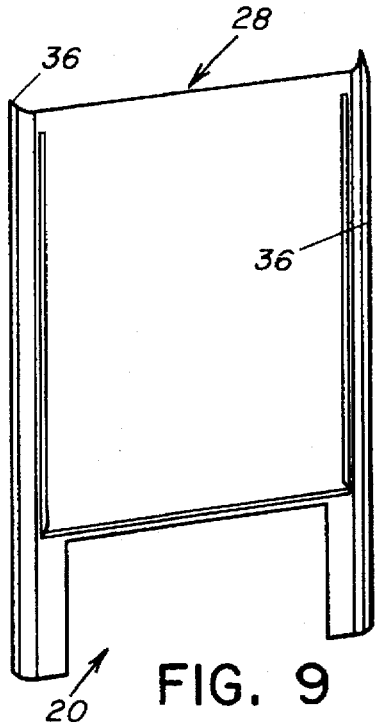
FIG. 9 is a rear perspective view of the front panel.
Figure 8:
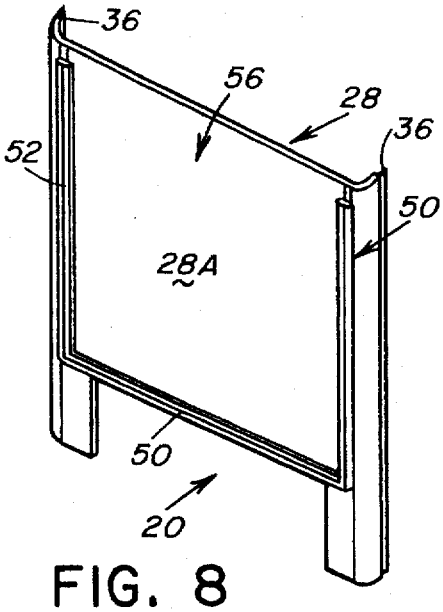
FIG. 8 is a front perspective view of a front panel of the storage and dispensing bin by itself.

Referring to FIG. 21, there is diagrammatically illustrated an alternative information display device 16 in the form of an electronic device as opposed to the physical or mechanical sheet S shown in FIGS. 1 and 2. The electronic display device 16 can be fabricated from any combination of suitable conventional electronic components. One example of such combination is a flat panel display 62 or the like which could be mounted to the frame 50 on the exterior side 28A of the front panel 28, an electronic control module 64 which could be mounted, for example, to the exterior side of the rear wall 22 of the bin 12 and housing a microprocessor along with other necessary electronic components, and a foot pedal 66 or the like which could be placed on the floor of the area below the scrub sink and has switches which a physician can depress by using his or her foot in order to activate the control module 64 to retrieve visual information from the memory of the microprocessor and present it on the flat panel display 62 whereby the physician can review and interact with the displayed information (e.g. via menu selection or self-assessment examination) while scrubbing up and dressing in the scrub area.

It is thought that the present invention and many of its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A dual-purpose storage and display apparatus for storing articles, dispensing the articles, and displaying information, said apparatus comprising:

(a) a storage and dispensing bin including (i) a main enclosure having a rear wall, a pair of opposite side walls connected to said rear wall and a bottom wall connected to said rear wall and opposite side walls such that said main enclosure has an open front and an open top, and (ii) a front panel mounted to front edge portions of said opposite sides of said main enclosure and extending across said open front of said main enclosure, said main enclosure and front panel together defining an interior chamber in said bin for storing articles therein, said front panel having a dispensing opening through which articles can be removed by users from said interior chamber of said bin;

(b) an information display device mounted to said front panel of said bin and adapted to hold and display information intended for the users who remove articles from said bin, said information display device being disposed on said front panel above said dispensing opening through said front panel;

(c) first connection elements defined along opposite side edges of said front panel; and (d) second connection elements defined along opposite front edges of said main enclosure, said first connection elements slidably interfitting with said second connections elements so as to permit said front panel to be slidably lifted and raised relative to said main enclosure in order to remove empty packages from said interior chamber and to replenish said interior chamber with new full packages of articles.

2. The apparatus of claim 1 wherein said front wall is shorter in height than said rear wall and said opposite side walls have respective top edges which slope forwardly and downwardly from a top edge of said rear wall to a top edge of said front wall so as to define said open top of said bin in a rearwardly and upwardly inclined orientation.

3. The apparatus of claim 1 further comprising:

a top cover movable relative to said bin for opening and closing said open top of said bin.

4. The apparatus of claim 3 wherein said top cover includes a pocket for holding a description of the contents of said bin.

5. The apparatus of claim 3 further comprising:

hinge means pivotally mounting said top cover to an upper portion of said bin in order for said top cover to undergo pivotal movement between opened and closed positions relative to said open top of said bin.

6. The apparatus of claim 1 further comprising:

a leaf spring removably mounted to said bin so as to extend into said interior chamber thereof for engaging articles therein and biasing the articles toward said dispensing opening in said bin.

7. The apparatus of claim 1 wherein said front panel is shorter in height than said rear wall and said opposite side walls have respective top edges which slope forwardly and downwardly from a top edge of said rear wall to a top edge of said front panel so as to define said open top of said bin in a rearwardly and upwardly inclined orientation.

8. The apparatus of claim 1 further comprising:

a top cover movable relative to said bin for opening and closing said open top of said bin.

9. The apparatus of claim 1 further comprising:

a top cover pivotally mounted to an upper edge portion of said rear wall of said main enclosure thereof for undergoing movement between opened and closed positions relative to said open top of said bin.

10. The apparatus of claim 1 wherein said information display device includes frame means mounted to said front panel of said Sin for defining a window and a slot at least partially surrounding said window for receiving the insertion therein of a sheet containing information thereon for viewing through said window.

11. The apparatus of claim 10 wherein said information display device further includes a pane of transparent material mounted to said frame means and extending across said window so as to substantially cover the sheet received behind said pane in said slot of said frame means.

* * * * *